US008480602B1

(12) United States Patent
Cook

(10) Patent No.: US 8,480,602 B1
(45) Date of Patent: Jul. 9, 2013

(54) REHABILITATION APPARATUS FOR CORRECTING AMBULATION

(76) Inventor: Gerry Cook, Sandpoint, ID (US)

( * ) Notice: Subject to any disclaimer, the term of this patent is extended or adjusted under 35 U.S.C. 154(b) by 212 days.

(21) Appl. No.: 12/932,277

(22) Filed: Feb. 22, 2011

Related U.S. Application Data

(60) Provisional application No. 61/338,632, filed on Feb. 22, 2010.

(51) Int. Cl.
*A61H 3/00* (2006.01)

(52) U.S. Cl.
USPC ..... 601/35; 601/23; 601/33; 601/34; 482/54; 482/69

(58) Field of Classification Search
USPC ..... 601/23–24, 35; 602/32–35; 482/24, 482/51, 54, 69, 91, 143, 148; 128/869, 873–876; 434/247
See application file for complete search history.

(56) References Cited

U.S. PATENT DOCUMENTS 3,252,704 A 5/1966 Wilson
3,780,663 A * 12/1973 Pettit ..... 104/307
3,877,421 A * 4/1975 Brown ..... 601/23
4,303,041 A * 12/1981 Thompson et al. ..... 482/66
4,905,989 A 3/1990 Colvin et al.
5,713,840 A * 2/1998 Brentham ..... 602/19
6,189,158 B1 * 2/2001 Lehoux ..... 2/455
6,689,075 B2 2/2004 West
6,752,776 B2 6/2004 West
7,066,181 B2 6/2006 West
7,544,155 B2 6/2009 Agrawal et al.
7,780,587 B2 8/2010 Thornton et al.
2004/0143198 A1 7/2004 West
2009/0032333 A1 * 2/2009 Wolner et al. ..... 182/3

* cited by examiner

*Primary Examiner* — Justine Yu
*Assistant Examiner* — Timothy Stanis
(74) *Attorney, Agent, or Firm* — Richard C. Conover

(57) ABSTRACT

Rehabilitation apparatus for use with unweighting apparatus including a vest having shoulder straps connected to the unweighting apparatus. Also included are a pair of thigh cuffs having resistance straps connected to the unweighting apparatus and a pair of foot straps having gait straps connected to the unweighting apparatus. An elongate roll is suspended from the vest and extends across the patient adjacent the pelvis area of the patient. The resistance straps and gait straps are threaded through loops provided on the front fact of the elongate roll.

2 Claims, 9 Drawing Sheets

REHABILITATION APPARATUS FOR CORRECTING AMBULATION

This application claims the benefit of provisional application Ser. No. 61/338,632 filed on Feb. 22, 2010.

BACKGROUND OF INVENTION

The present invention relates to rehabilitation apparatus used in conjunction with unweighting apparatus for correcting ambulatory problems. A need exists for rehabilitation apparatus which includes structure anchored to the user for converting the vertical resistance force provided by the unweighting apparatus to a resistance force having a horizontal component for acting on the hip flexors and extensors of a patient when walking.

SUMMARY OF INVENTION

A human body rehabilitation apparatus for use with unweighting apparatus having an overhead spreader bar having a vest for fitting around a waist of a patient and a left side shoulder strap and a right side shoulder strap each attached to the vest and each having a distal end connected to the overhead spreader bar. A left side thigh cuff and a right side thigh cuff for fitting around the thighs of a patient and having an adjustable length first resistance strap connected between the left side thigh cuff and the overhead spreader bar and a second adjustable length resistance strap having one end secured to the right side thigh cuff and a distal end connected to the overhead spreader bar. A left side foot strap and a right side foot strap are provided for fitting around the forward end of the left and right foot, respectively, of a patient. An adjustable length first gait strap has one end secured to the left side foot strap and a distal end connected to the spreader bar and an adjustable length second gait strap having one end secured to the right side foot strap and a distal end secured to the spreader bar. An elongate roll having a preselected thickness is suspended from the vest and positioned to extend laterally across the patient below the vest adjacent the pelvis area of the patient. The elongate roll having a series of spaced apart loops extending across the face of the elongate roll for selectively receiving the first and second resistance straps and the first and second gait straps. The elongate roll is used to convert an essentially vertical upward forces provided by the unweighting apparatus through the first and second resistance straps and the first and second gait straps to forces having a horizontal component.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
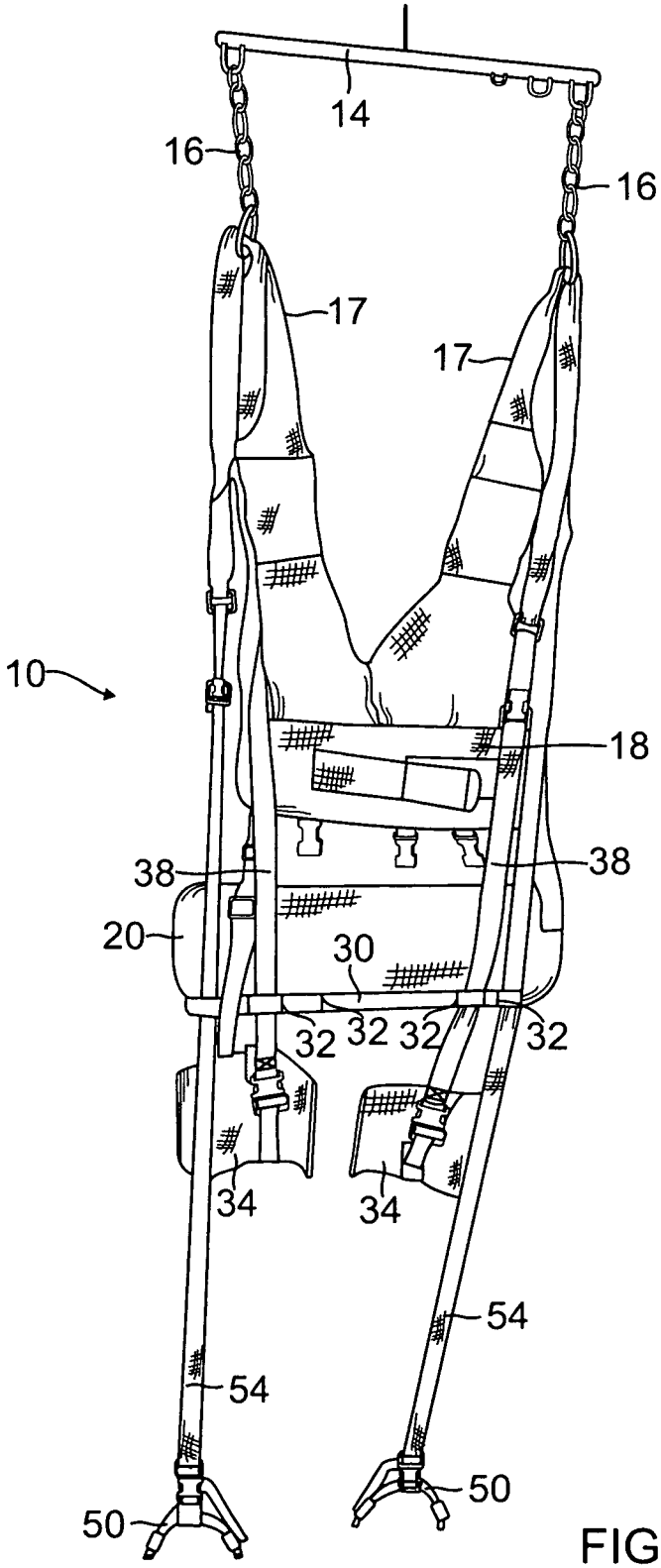
FIG. 1 is a perspective plan view of the rehabilitation apparatus according to the present invention.

Rehabilitation apparatus 10 for correcting ambulation is shown in FIG. 1 and described in Exhibit A attached hereto and incorporated herein by reference.

Figure 2:
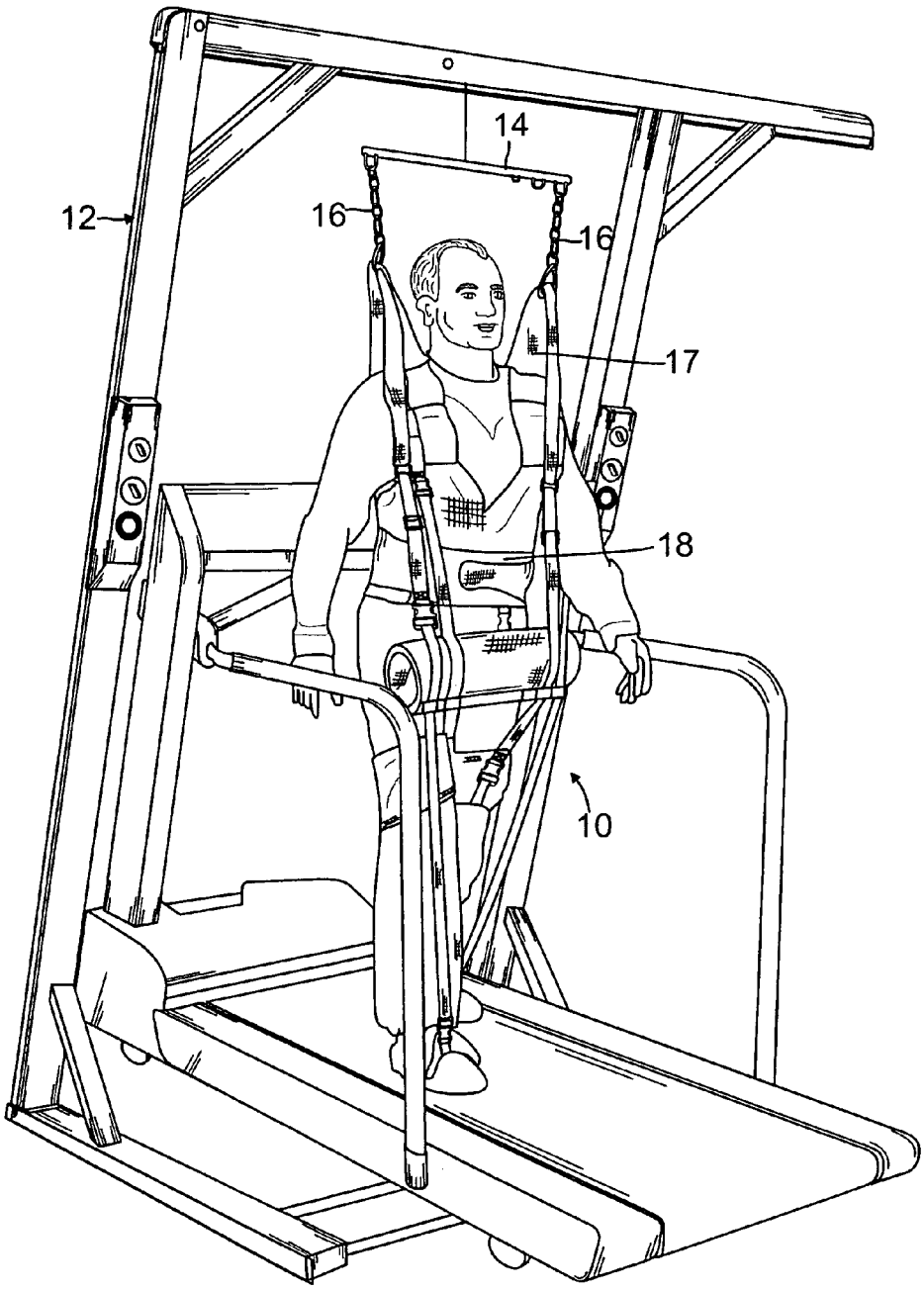
FIG. 2 is a perspective view of the rehabilitation apparatus shown in FIG. 1 fitted on a patient.
Figure 3:
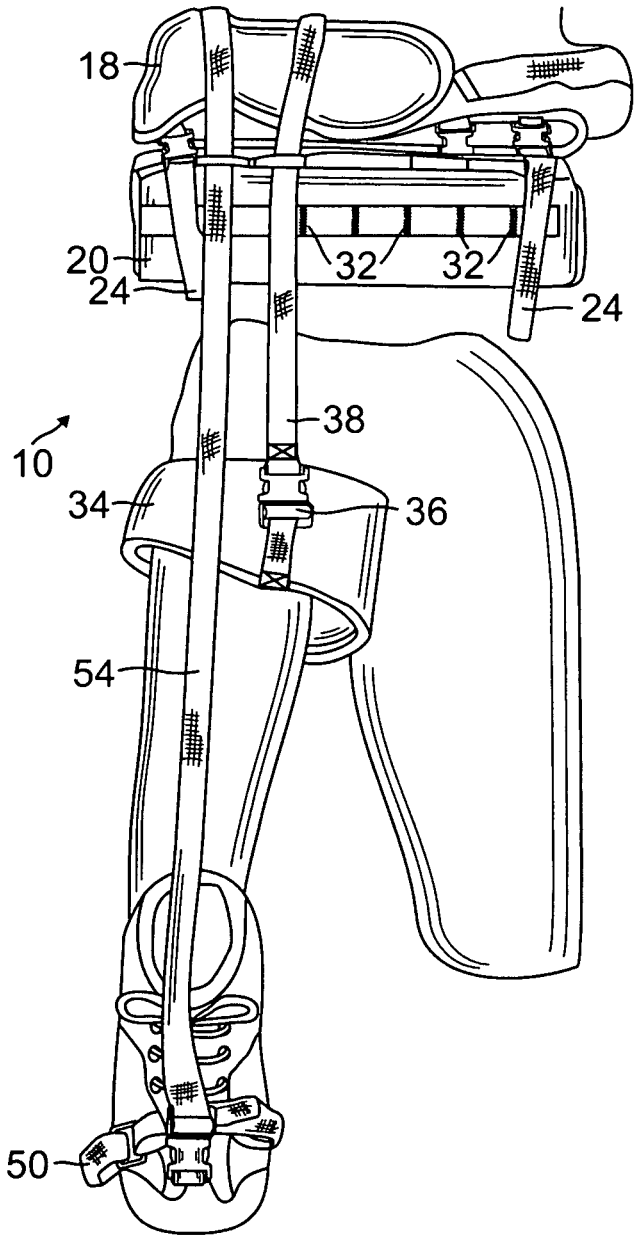
FIG. 3 is a partial plan view of the rehabilitation apparatus shown in FIG. 1 fitted on one leg of a patient.

The rehabilitation apparatus 10, shown in FIG. 1, is used in conjunction with unweighting apparatus 12 as shown in FIG. 2. A spreader bar 14 is suspended from the unweighting apparatus 12. A pair of suspension chains 16 are attached to the spreader bar 14 and are adapted for connecting to the shoulder straps 17 of a vest 18 as shown in FIG. 1. The rehabilitation device 10 as shown in FIG. 3 is configured with one leg of a patient. A similar configuration is used for the other leg of the patient but is not shown in this figure for clarity.

Figure 4:
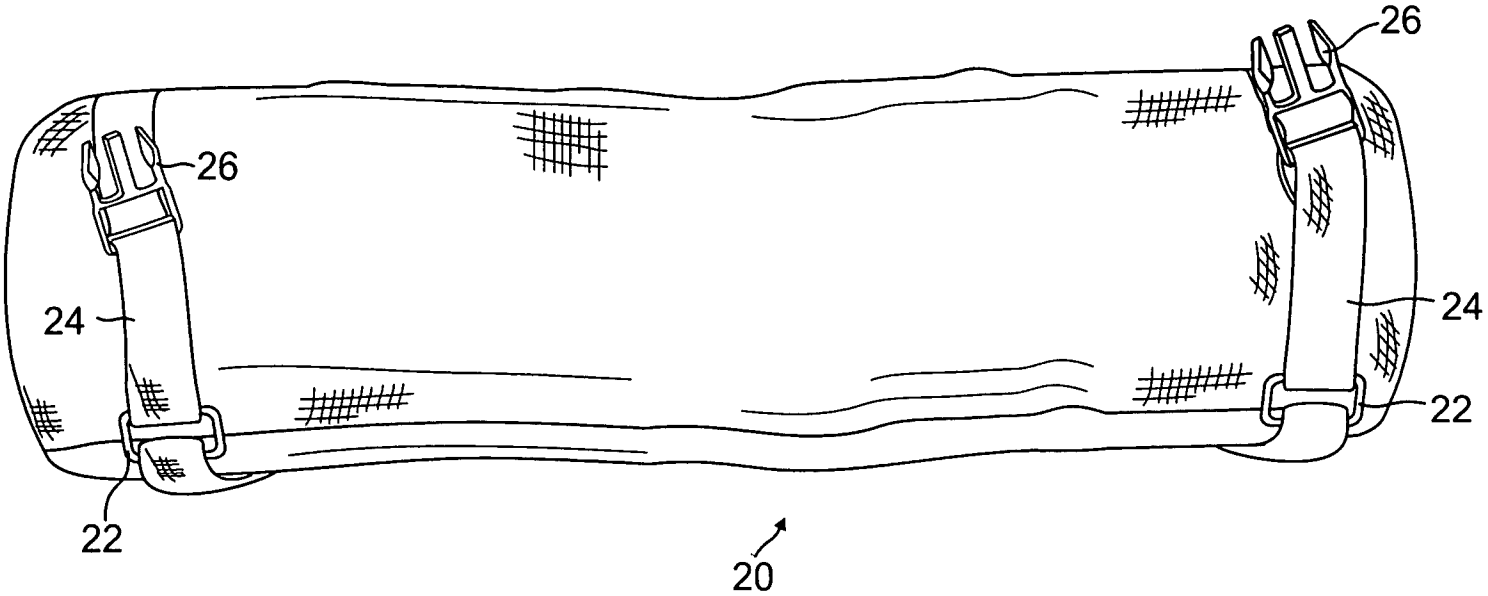
FIG. 4 is a plan view of a cylindrical body used with the present invention.
Figure 5:
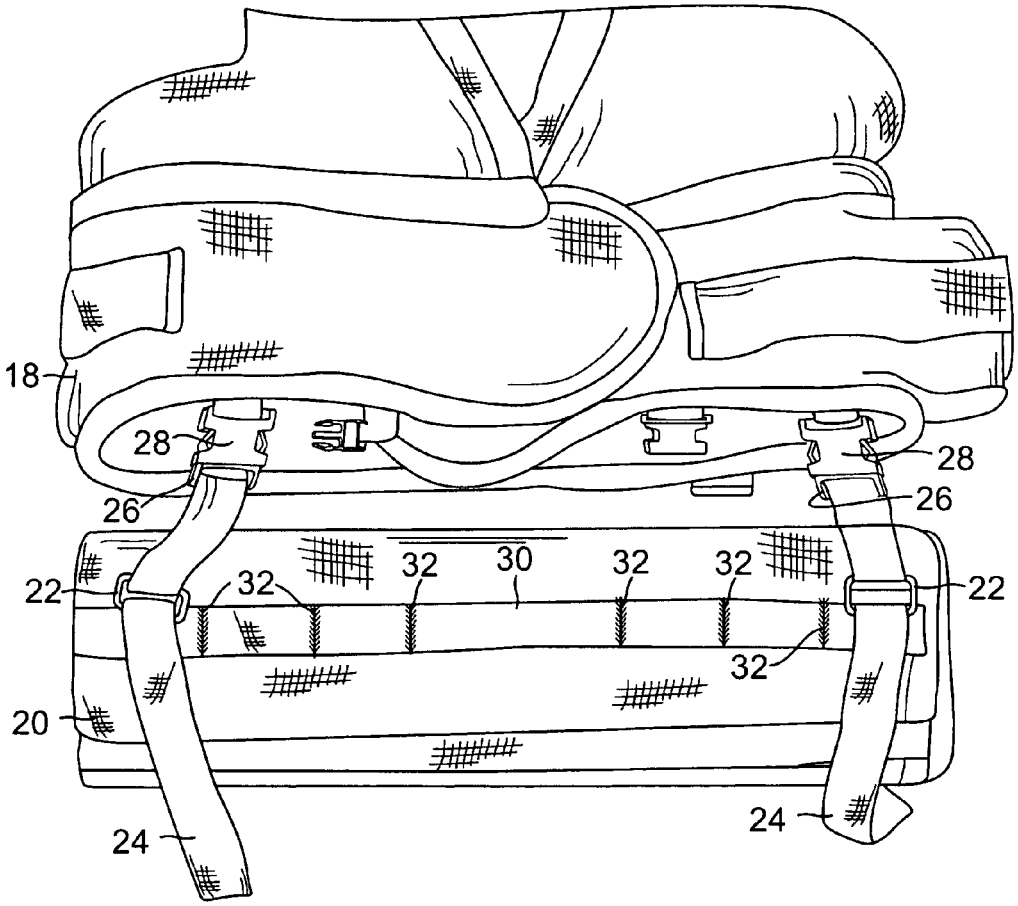
FIG. 5 is a detail view showing the attachment of the cylindrical body shown in FIG. 4 to a vest worn by a patient.

The rehabilitation device includes an elongate roll 20 preferably constructed of a semi-rigid material. The elongate roll 20 is shown in FIG. 4. The elongate roll 20 includes a pair of length adjustment buckles 22 attached to the elongate roll 20 as shown in FIGS. 4 and 5. A strap 24 is threaded through each of the length adjustment buckles 22 as shown in FIG. 5 and a male buckle 26 is secured to the strap 24 at one end thereof. The male buckle 26 is connected to a female buckle 28 attached to the vest 18. As shown in FIG. 5, there are buckles 28 attached to the vest on the anterior and posterior sides of vest 18.

A strap 30 is sewn to elongate roll 20 at spaced apart locations forming loops 32 as shown in FIG. 5 on both the anterior and posterior sides of elongate roll 20.

Figure 6:
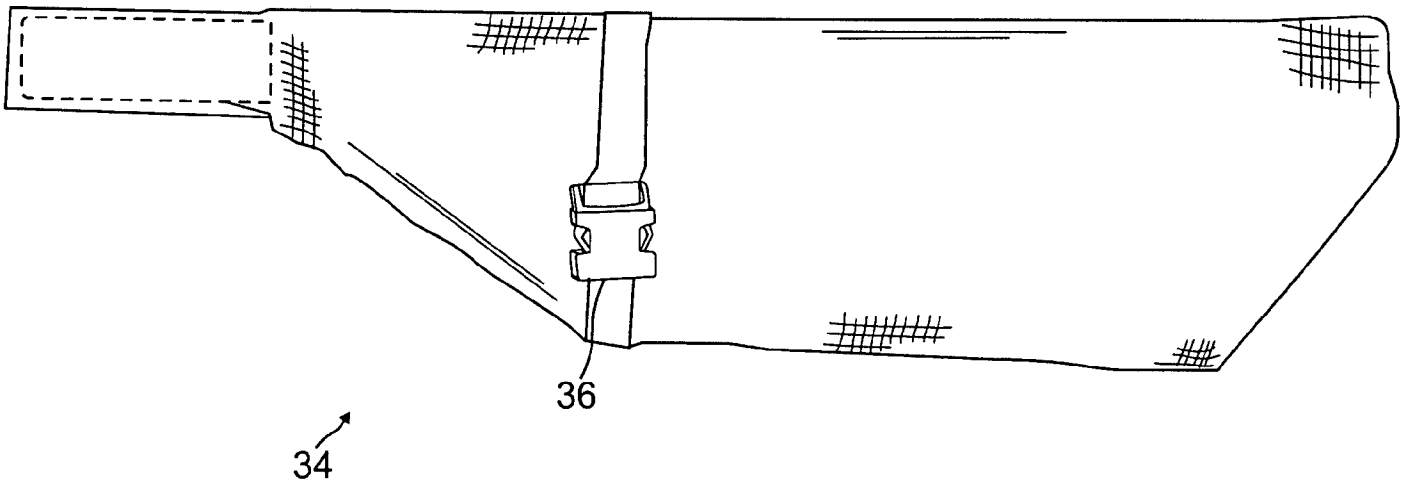
FIG. 6 is a plan view of a thigh cuff used with the present invention.
Figure 7:
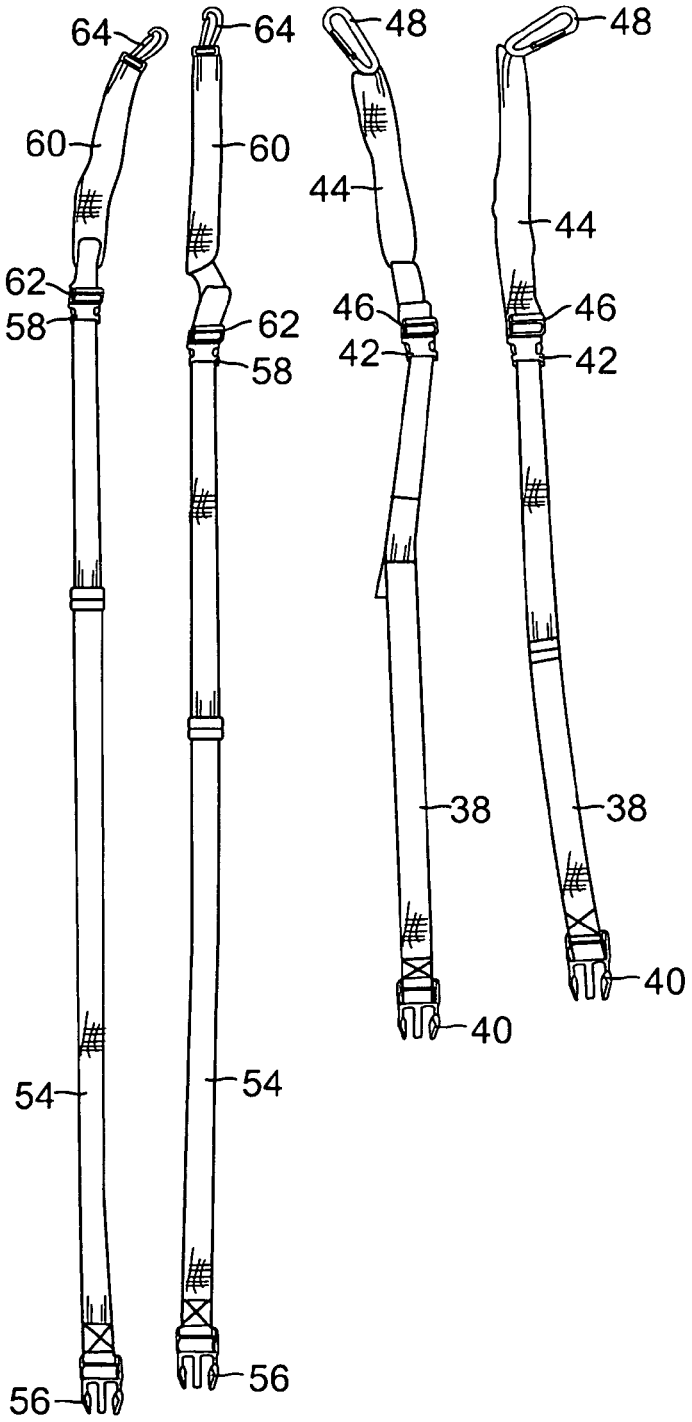
FIG. 7 is a plan view of resistance straps used with the present invention.
Figure 8:
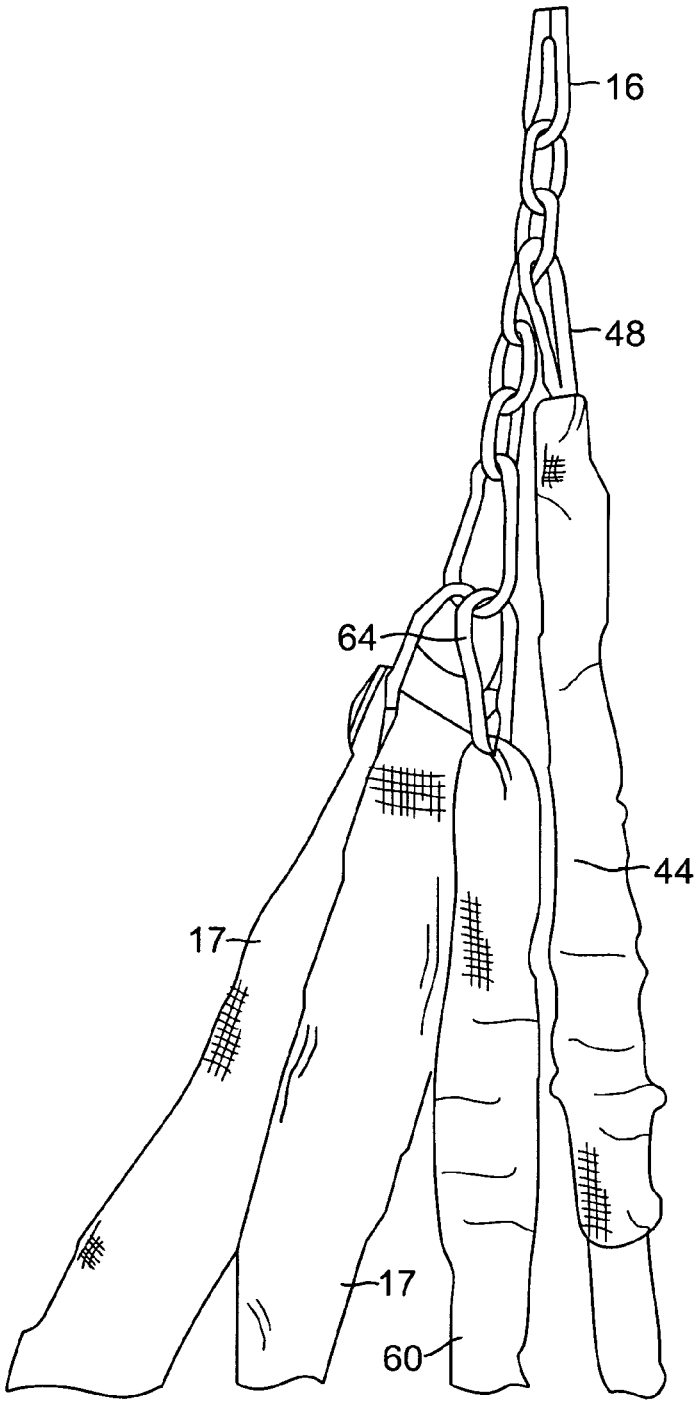
FIG. 8 is a perspective view of the attachment of shoulder straps of a vest and resistance straps to a suspension chain connected to unweighting apparatus (not shown)

A thigh cuff 34 as shown in FIG. 6 is secured to a leg of a patient as shown in FIG. 3. There is provided a thigh cuff 34 for each leg of the patient. The ends of the cuff are secured together with a hook and loop connection (not shown). A female buckle 36 is secured to the thigh cuff 34 as shown in FIG. 6. A resistance strap 38, as shown in FIG. 7, has a male buckle 40 located at one end thereof. The male buckle 40 is used to secure the resistance strap 38 to the female buckle 36 of the thigh cuff 34. At the opposite end of the resistance strap 38 is secured a strap length adjusting female buckle 42. A strap 44 has a male buckle 46 secured at one end thereof for buckling with the female buckle 42 as shown in FIG. 7. At the opposite end of the strap 44 is secured a clip 48 for securing the strap 44 to the suspension chain 16 as shown in FIG. 8.

Figure 9:
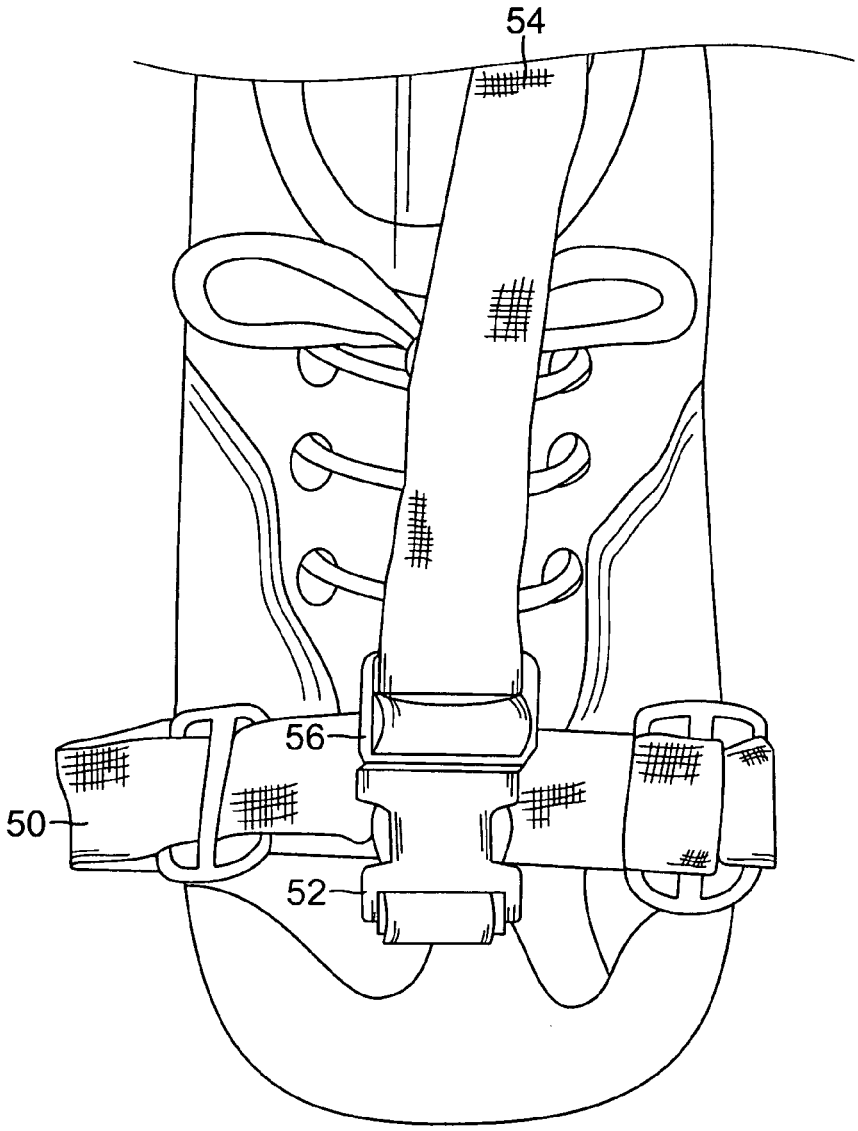
FIG. 9 is a perspective view of a foot strap used with the present invention fitted on a foot of a patient.

A foot strap 50, as shown in FIG. 9, is adapted for fitting around the forward end of a foot of a patient. There is provided a foot strap 50 for each foot of the patient. The foot strap 50 is provided with a female buckle 52. A gait strap 54, as shown in FIG. 7, has a male buckle 56 located at one end thereof for buckling with the female buckle 52 of the foot strap 50 as shown in FIG. 9. At the opposite end of the gait strap 54 is provided a strap length female buckle 58. A strap 60 has a male buckle 62 secured at one end thereof for buckling with the female buckle 58 as shown in FIG. 7. At the opposite end of strap 60 is provided a clip 64 for attachment with a suspension chain 56 as shown in FIG. 8.

The elongate roll 20, as used with the present invention, is used to convert the essentially vertical vector of the resistance force acting through resistance straps 38 and gait straps 54 on the thigh and foot respectively of a patient to a vector having a horizontal component.

The rehabilitation device 10 may be used in different configurations to correct various ambulatory problems. For example, in a first set up the elongate roll 20 is suspended from the vest 18 with straps 24 and buckles 28 in an anterior position as shown in FIG. 2 and FIG. 5. Thigh cuffs 34 are secured to the legs of a patient with the buckles 36 positioned on the anterior side of the thigh. The resistance straps 38 are threaded through loops 32 provided on the anterior side of elongate roll 20. The resistance straps 38 are then connected to chain 16 as shown in FIGS. 7 and 8 through length adjustment buckles 42 and 46. The length of resistance straps 38 are adjusted to adjust the unweighting tension on each leg. When a patient walks on a tread mill as shown in FIG. 2 the resistance straps 38 assist the hip flexors and provide resistance to the extensors. For a wider gait, resistance straps 38 are threaded through outer loops 32. For a narrower gait, the straps 38 are threaded through inner loops 32.

As another example, the elongate roll 20 is suspended from the vest 18 in a posterior position with straps 24 working in cooperation with buckles 28 provided on the posterior side of the vest 18. Thigh cuffs 34 are secured to the legs of a patient with the buckles 36 positioned on the posterior side of the thighs. The resistance straps 38 are threaded through loops 32 provided on the posterior side of the elongate roll 20. The resistance straps are then connected to chain 16 as with the first example. The length of resistance straps are adjusted to adjust the unweighting tension on each leg. With this arrangement, when a patient walks on a tread mill the resistance straps 38 assist the extensors and provide resistance to the hip flexors. Again, for a wider gait, resistance straps 38 are threaded through outer loops 32. For a narrower gait the straps 38 are threaded through inner loops 32.

As a further example, and as shown in FIG. 2, the elongate roll 20 is suspended from the vest 18 in an anterior position with straps 24 and buckles 38. Thigh cuffs are secured to the legs of a patient with the buckles 36 positioned on the anterior side of the thigh. The resistance straps 38 are threaded through loops 32 provided on the anterior side of elongate roll 20. The resistance straps are then connected to chain 16 and the length adjusted to adjust the unweighting tension on each leg. The foot straps 50 are then fitted around the forward end of the feet as shown in FIG. 9. The gait straps 54 are then threaded through the middle loops 32 provided on the anterior side of elongate roll 20 and then connected to chain 16 as before through length adjustment buckles 58 and 62. The length of gait straps 54 are adjusted to adjust the unweighting tension on each foot. With this arrangement the walking pattern of a patient is modified to have a controlled heel strike.

While the fundamental novel features of the invention have been shown and described, it should be understood that various substitutions, modifications, and variations may be made by those skilled in the arts, without departing from the spirit or scope of the invention. Accordingly, all such modifications or variations are included in the scope of the invention as defined by the following

I claim:

1. A human body rehabilitation apparatus for use with an unweighting apparatus having an overhead spreader bar comprising a vest for securely fitting around a waist of a patient;

a left side shoulder strap and a right side shoulder strap, each attached to the vest and each having a portion connected to a separate suspension chain attached to the overhead spreader bar;

a left side thigh cuff and a right side thigh cuff;

an adjustable length first resistance strap having one end secured to the left side thigh cuff and a distal end secured to the corresponding suspension chain;

a second resistance strap having one end secured to the right side thigh cuff and a distal end secured to the corresponding suspension chain; and an elongate roll having a preselected thickness, the elongate roll suspended from the vest and positioned to extend laterally across the patient below the vest adjacent a pelvis area of the patient;

the elongate roll having a series of spaced apart loops extending across a front face of the elongate roll for selectively receiving the first and second resistance straps;

whereby the elongate roll converts an essentially vertically upward force provided by the unweighting apparatus through the first and second resistance straps to a force which has a horizontal component.

2. The human body rehabilitation apparatus according to claim 1 further including:

a left side foot strap for fitting around a forward end of a left foot of a patient and a right side foot strap for fitting around a forward end of a right foot of a patient;

a first gait strap having one end secured to the left side foot strap and a distal end secured to the corresponding suspension chain;

a second gait strap having one end secured to the right side foot strap and a distal end secured to the corresponding suspension chain;

the first and second gait straps threaded through selected loops provided in the elongate roll;

whereby the elongate roll connects an essentially vertically upward force provided by the unweighting apparatus through the first and second gait straps to a force having a horizontal component.

* * * * *